United States Patent [19]

Middlemark

[11] 3,961,332

[45] June 1, 1976

[54] ELONGATED TELEVISION RECEIVING ANTENNA FOR INDOOR USE

[76] Inventor: Marvin P. Middlemark, 96 Store Hill Road, Old Westbury, Long Island City, N.Y. 11568

[22] Filed: July 24, 1975

[21] Appl. No.: 598,573

[52] U.S. Cl. ..... 343/802; 343/792; 343/793

[51] Int. Cl.[2] ..... H01Q 9/16

[58] Field of Search ..... 343/792, 793, 794, 795, 343/796, 785, 802, 803, 804, 805, 807

[56] References Cited

UNITED STATES PATENTS

| | | | |
|---|---|---|---|
| 2,486,597 | 11/1949 | Greene | 343/792 |
| 2,636,986 | 4/1953 | Riderman | 343/802 |
| 2,724,773 | 11/1955 | Klancnik, Jr. | 343/802 |
| 3,139,620 | 6/1964 | Leioy et al. | 343/792 |
| 3,818,488 | 6/1974 | Majkrzak et al. | 343/792 |

FOREIGN PATENTS OR APPLICATIONS

| | | | |
|---|---|---|---|
| 475,855 | 11/1937 | United Kingdom | 243/792 |

*Primary Examiner*—Alfred E. Smith
*Assistant Examiner*—Tommy P. Chin
*Attorney, Agent, or Firm*—S. Stephen Baker

[57] ABSTRACT

An elongated, rigid, television frequency antenna of the dipole type, for indoor reception use, including a long, flexible, lead-in or transmission line for connection to a television set, the antenna itself being otherwise physically free, with no supporting structure of its own, so that it may be disposed in innumerable positions, or diverse orientation within a room, for maximum reception. Both of the dipole elements are enclosed within a single plastic, elongated sturdy tube resembling a stick, for facilitating selective and desired orientation of the antenna, and supported in such orientation by the floor, or walls of the room. The transmission line is also so connected to the dipole that it modifies the characteristics of one half of the dipole more than the other, thus providing greater choice of orientation.

2 Claims, 4 Drawing Figures

ELONGATED TELEVISION RECEIVING ANTENNA FOR INDOOR USE

BACKGROUND OF THE INVENTION

The present invention relates generally to indoor television antennas which are capable of positioning or orientation for securing maximum reception as may be required for differently located stations or other area conditions which affect reception.

To my knowledge, antennas of the above type are either directly built into the television receiver, or comprise a separate component, usually resting on or adjacent to the set, with a transmission line for connecting the antenna to the set. In practically all cases, the antenna elements, generally of the so called rabbit ear type, are manually adjustable for maximum reception. This applies also when the antenna comprises only one element instead of the two element rabbit ear type. The transmission line depends directly from the terminal contact portion of the antenna, to the input contact arrangement of the receiver set.

Accordingly, the antenna itself, considering it as a body, is capable of no or very limited physical adjustability relative to the set. Of course, the reception elements thereof are widely adjustable as opposed to the limited adjustability of the unit as a whole relative to the set. It is further notable that when the transmission line or equivalent connection structure depends directly from the terminal contacts of a twin, or rabbit ear type antenna, the twin antenna elements are equally electrically affected by the transmission component. This aspect constitutes another limitation on the versatility of adjustment capability of the antenna.

SUMMARY OF THE INVENTION

Accordingly, it is an object of the present invention to provide an indoor television antenna of the dipole type which although connected to the receiver set by conventional transmission line, is capable of virtually infinite disposition bodily, relative to the set. Obviously therefore, its dipole elements are adjustable in effect, because they are carried by the body of the antenna itself.

Another object of this invention is to encase the dipole elements within an elongated, rigid, hollow plastic tube so that the antenna body itself resembles a rigid stick capable of supporting itself in a great variety of positions, the enclosed dipole likewise assuming any such position.

Another object of this invention is to connect flexible transmission cable to the dipole inner terminals by inserting the cable into the plastic tube as far as the dipole inner terminals so as to be connectable thereto. The cable may then be substantially concentric with the longitudinal axis of the elongated tube.

Another object of this invention is to provide a selective co-action between the transmission cable and the dipole elements. More specifically, the cable is positioned to co-act electrically with only one of the two dipole elements. Such co-action modifies the characteristic impedance of that one element. Accordingly, the antenna will have different reception characteristics by virtue of physically disposing it in a manner which selectively presents either dipole element in a desired position relative to the direction of the received electromagnetic wave. Allied with this object is the objective of so forming the dipole elements that the one co-acting with the cable has a greater degree of co-action than would be normally expected.

I achieve the above and more objects by forming the antenna body from an hollow, elongated, rigid plastic tube which firmly encloses the dipole elements in a fixed position relative to the plastic tube. The dipole elements are preferably, but not necessarily, of coiled spiral tube configuration which is concentric with the body plastic tube. A flexible co-axial cable is provided which enters the spiral tube and is thus of course also enclosed within the body plastic tube. The co-axial cable extends only to about the center of the body plastic tube so as to reach the inner terminals of the respective dipole elements, where it is effectively connected to the dipole. Since the co-axial cable is therefore closely adjacent to only one dipole element, it acts like a coupling line with said one dipole element and thereby modifies the characteristic impedance of that one dipole element, while having no such effect on the other element.

Further, in the preferred state where the dipole elements are coiled and spirally circularly hollow, they exhibit by themselves an induction which can be considered as a loading of the element. The spiral coils thus comprise a series impedance along the length of the element. It is well known that a loading coil has this effect, its benefit being to effectively lengthen the element so as to better approach the ideal dipole length which of course comprises two aligned quarter wave elements at the frequency involved. All antennas of this type are considered to be broad band although it is obvious that they cannot really be so, but represent compromises. At any rate, the enclosed portion of the co-axial cable is a parallel or shunt impedance to the surrounding coil element, its effect being greater than if the element were straight or non-inductive. These inductive and impedance effects are believed to produce a power loss or radiation resistance which increases the efficiency of the antenna, the general principle being well recognized.

Still another object of this invention is to form the flexible transmission cable of sufficient length so as to constitute it of practically no physical limitation toward disposing the antenna body in substantially any position of orientation and any reasonable distance from the television set which is normally disposed within a room of a dwelling. As will appear hereinafter, it is considered that the length of the cable extending from the antenna body will ordinarily be between about three to eight feet and generally greater than the length of the antenna body.

DESCRIPTION OF THE PREFERRED EMBODIMENT

Figure 1:
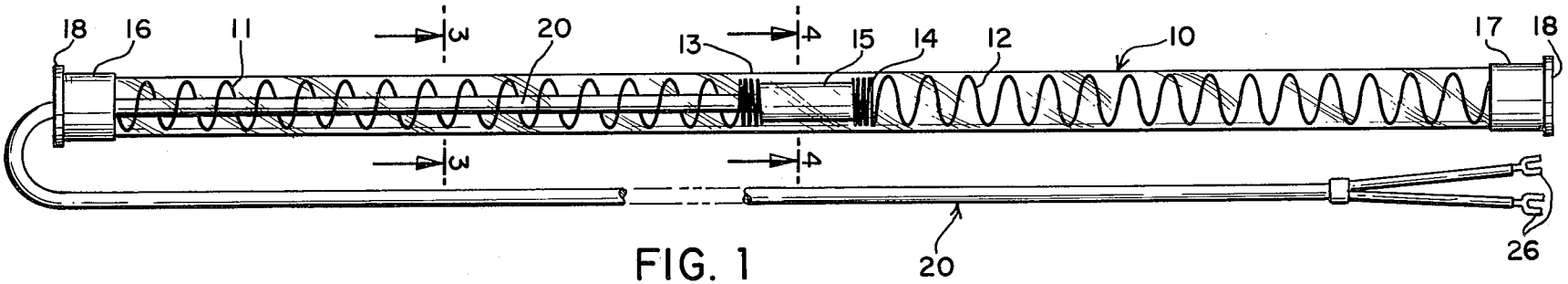
FIG. 1 is an elevational view of the antenna, the transmission cable being shown broken away to designate it to be of greater length than that indicated.
Figure 2:
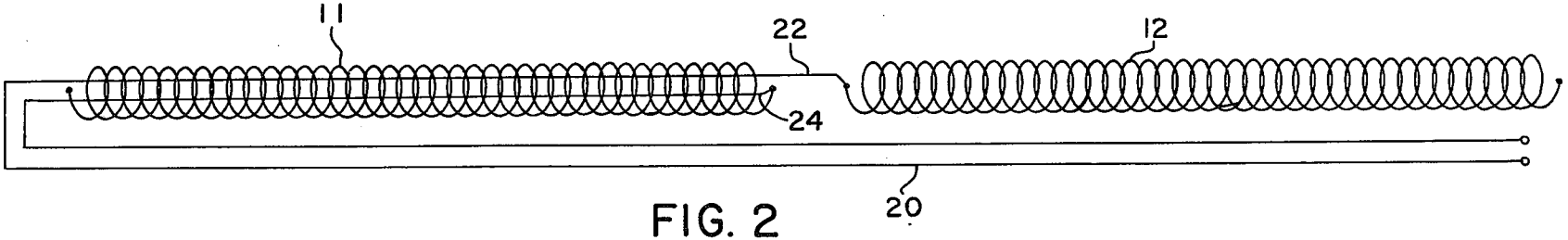
FIG. 2 is an electrically schematic view thereof.

The antenna comprises a rigid tubular elongated body 10 of plastic material such as polyethylene. It may be transparent, mainly for aesthetic reason. Purely for specifically describing a model which functioned satisfactorily, specific dimensions will be given hereinafter, but for purposes of describing an example, body 10 may be about three feet in length, end to end. Its outer diameter is about ⅝ inch to ⅞ inch or so. The thickness of the plastic forming body 10 is 1/16 inch. All these dimensions are to be understood as being simply representative. Body 10, for all practical purposes is entirely rigid, just as would be, as an analogy, an ordinary stick. Of course, untoward pressure could bend it, but that is not its intended purpose for best results.

Entirely disposed within body 10 is a dipole comprised of the aligned dipole sections 11 and 12. In the preferred form shown, and for superior results, sections 11 and 12 are of coiled spiral form, each about one half of the length of body 10. The coiled form gives them a distributed inductive effect somewhat similar to the function of a lumped loading coil, although of less inductance thereof largely because of the relatively lesser number of coils in the antenna as shown herein. The coils of the confronting, adjacent inner ends 13 and 14 of the respective dipole sections may be more compacted as shown. This serves the function of increasing the inductance while at the same time facilitating assembly of the antenna because such compacted ends are obviously more rigid physically. The wire used for forming the dipole is not at all critical, normally being of resilient metal of about 1/32 inch diameter and usually coated by insulation.

The aligned dipole sections 11 and 12 are physically separated by a short plastic tube 15, while the open ends of the tubular body 10 are firmly enclosed by plastic end caps 16 and 17, such caps being frictionally retained over the respective body ends. End cap 16 has a central hole the purpose of which will be hereinafter made clear. Each cap has an enlarged end rim 18 which extends outwardly of the cap body about 1/16 inch. As will be shown hereinafter, these cap rims elevate the entire body over a horizontal supporting surface on which the antenna may rest, such surface for example, being the room floor where the television receiver is located.

A co-axial transmission cable 20 is provided. It will normally be longer than body 10, for example, from somewhat over three feet, to as much as seven feet, referring to the portion thereof extending from body 10. Its typical characteristic impedance will be about 72 ohms, and its overall physical diameter about 3/16 inch.

Figure 3:
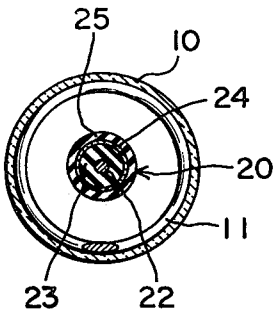
FIG. 3 is an enlarged cross-sectional view as taken along the line 3—3 of FIG. 1.
Figure 4:
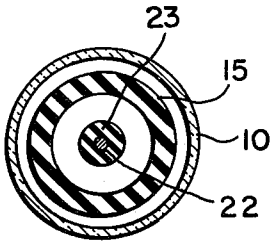
FIG. 4 is an enlarged cross-sectional view as taken along the line 4—4 of FIG. 1.

One end of co-axial cable 20 penetrates through the central hole of end cap 16 and extends inwardly through tube 10 up to the inner terminal end of dipole secton 11, which is of course, in the form shown, at about the center of tube 10. Accordingly, the portion of the transmission line co-axial cable 20 which enters the tube 10, is co-extensive with the first aligned dipole section 11. Further, it will be recognized that tube 10, coiled dipole section 11, and cable 20, are all substantially bodily concentric as is evident from FIG. 3. Referring further to FIG. 3, the co-axial cable 20 is obviously of conventional construction, comprising as it does an inner, central wire 22 surrounded by insulating plastic 23, a braided sheath wire 24 serving as the opposing wire, and an outer rubberlike coating 25. The connection of the wires 22 and 24 to the respective aligned dipole sections 11 and 12 is obvious, one of said wires being connected to the inner terminal end of dipole section 11, and the other going through hollow spacer tube 15 and connecting to the inner terminal end of dipole section 12. In general, such connection of a transmission cable to a dipole is of course routine.

The fact that in this antenna, the portion of cable 20 which enters the tube 10 only extends to the center of the tube 10, has a special significance and effect. First aligned section 11, being coiled, has a distributed inductance as heretofore explained. Cable 20 has an inductive coupling co-action with dipole section 11, but not with dipole section 12, with which it has no such effect. The significance thereof will be hereinafter made clear. It will be understood by those skilled in the art that the thus enclosed portion of cable 20 acts as a parallel or shunt impedance to the surrounding coiled dipole section 11.

The antenna as fully described above has many modes of usage. Thus, after its terminal clips 26 are connected to the input terminals of a television receiver, the rigid antenna body 10 may be deposited flatly along the room floor, or on the set itself. It may then be easily rotated horizontally for best visual reception. Indeed, since the length of cable 20 so exceeds the length of body 10, the body 10 may be rotated 360° if desired. In a crowded urban area, the electromagnetic television waves may be reflected, re-reflected, etc., arriving from various directions, and with varying electrical characteristics relative to the frequency and the size or construction of the receiving antenna. Thus, the horizontal rotation or orientation of this antenna will produce varying and selective reception. Further, since section 11 has different electrical characteristics than section 12, it may be desirable to so orient the antenna that one of said sections receives and intercepts the waves before the other does. In any event, different results are achieved depending on such orientation. Diametrically enlarged rims 18 also serve a useful purpose since they elevate the body 10 over a supporting surface and thereby reduce capacitative losses.

Further, the rigid antenna makes possible other types of orientation. Due to the influence of buildings or other structures, waves may arrive either horizontally, or vertically polarized, or combinations thereof. The instant rigid antenna body may be substantially leaned vertically against a wall, or in a corner of the room. Even then, it may be reversed so that either section 11 or 12 is uppermost. This aspect increases the orientation capabilities.

While there has been described a preferred embodiment of my invention, it is apparent that numerous changes and omissions may be made without departing from its spirit. It may also be noted that the specific configuration of the dipole may be considerably altered while still retaining many advantages of the invention. Indeed, considerable advantages may be retained even if the dipole itself is conventional. Indeed, the coiled nature of the dipole itself is not new.

In a specific, well functioning embodiment in the UHF range, the overall body length was 40 inches; the length of cable extending from the body end was 50 inches; the length of the end caps was 1 inch; the diameter of the end caps, with the rims, was 1 inch, the diameter of the rims extending past the caps themselves being 1/16 inch; and the center spacer 15 was 1 inch in length. Of course these are simply representative dimensions and not at all critical.

What is claimed is:

1. An indoor television antenna comprising a rigid, elongated antenna body, said body being hollow, tubular, and formed of electrically insulating plastic material, a coiled spiral conductive elongated antenna element device for receiving broadcast directional television frequency waves and disposed within and substantially throughout the length of said body to define a dipole, and an elongated flexible transmission line having at least two conductors, one end of said line with its said conductors entering one end of said body and its said conductors at said one end of said line being connected to said dipole antenna at a central portion, and the conductors at the other end of said line being adapted for connection to the input system of a television receiver, the length of said transmission line between said one end of said body, and said other end of said line being greater than the length of said body, said body being free of supporting structure other than its own rigid tubular form and its said transmission line whereby said body may be freely physically oriented in any position of reception limited only by its end connection to said line.

2. An indoor television antenna according to claim 1 and including an end cap of insulating material at each end of said body, and a diametrically enlarged outer rim on each cap for jointly elevating said body over a support for said body when said body is horizontally disposed on said support.

* * * * *